United States Patent [19]

Simons

[11] 3,945,272

[45] Mar. 23, 1976

[54] THREAD-ROLLING METHOD, THREAD-ROLLING DIES, AND METHOD OF MANUFACTURING THE DIES

[75] Inventor: Leon Simons, New City, N.Y.

[73] Assignee: NL Industries Inc., New York, N.Y.

[22] Filed: June 11, 1974

[21] Appl. No.: 478,315

Related U.S. Application Data

[62] Division of Ser. No. 7,280, Jan. 30, 1970, abandoned.

[52] U.S. Cl. ..... 76/107 R; 72/88

[51] Int. Cl.[2] ..... B21K 5/20; B21H 3/06

[58] Field of Search ..... 76/107 R; 72/88, 90, 469; 10/10

[56] References Cited

UNITED STATES PATENTS

| | | | |
|---|---|---|---|
| 2,147,899 | 2/1939 | Hoern | 76/107 R |
| 2,165,008 | 7/1939 | Rosenberg | 76/107 R |
| 2,293,930 | 8/1942 | Braendel | 72/88 X |
| 2,324,143 | 7/1943 | Erdman | 76/107 R |
| 3,044,329 | 7/1962 | Seibert | 72/90 |
| 3,180,126 | 4/1965 | Carlson | 72/88 |
| 3,246,556 | 4/1966 | Phipard | 72/88 X |
| 3,504,722 | 4/1970 | Breed | 10/10 X |

FOREIGN PATENTS OR APPLICATIONS

| | | | |
|---|---|---|---|
| 491,710 | 9/1939 | United Kingdom | 76/107 R |

*Primary Examiner*—Leonidas Vlachos
*Attorney, Agent, or Firm*—Fitzpatrick, Cella, Harper & Scinto

[57] ABSTRACT

A thread-rolling method as well as thread-rolling dies and method for manufacturing the dies. The shank on which the thread is rolled has a tapered free end region, and the dies which are used for rolling the thread are initially made up of a pair of individual sections having flat and inclined die faces with these sections subsequently joined to each other to form the complete die. The threads may be of lobular configuration, and during the rolling of the thread itself the lobes are simultaneously formed. The lobes for the threads are achieved directly from the thread-rolling dies by pressing across the ridges thereof tools which form in the ridges indentations having a predetermined pattern of distribution which will achieve the required distribution of the lobes on the thread which is rolled.

2 Claims, 10 Drawing Figures

INVENTOR.
LEON SIMONS

BY

Blum, Moscovitz, Friedman & Kaplan
ATTORNEYS

FIG. 6
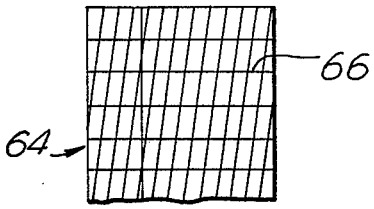
FIG. 7
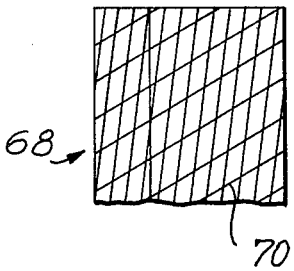
FIG. 8
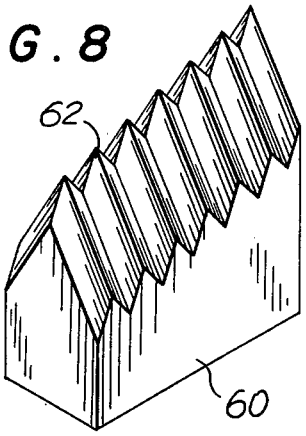
FIG. 9
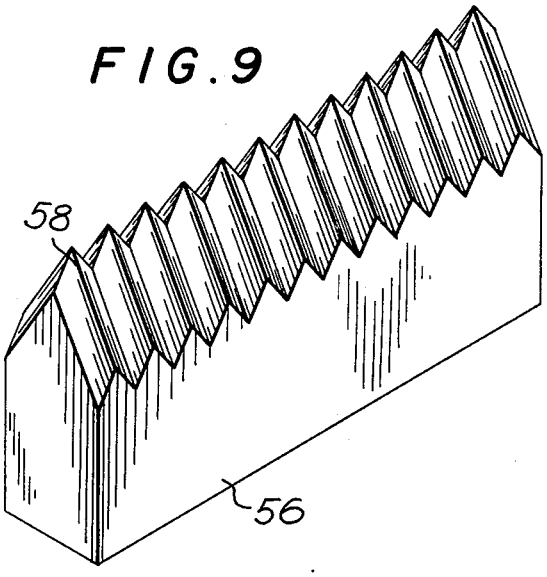
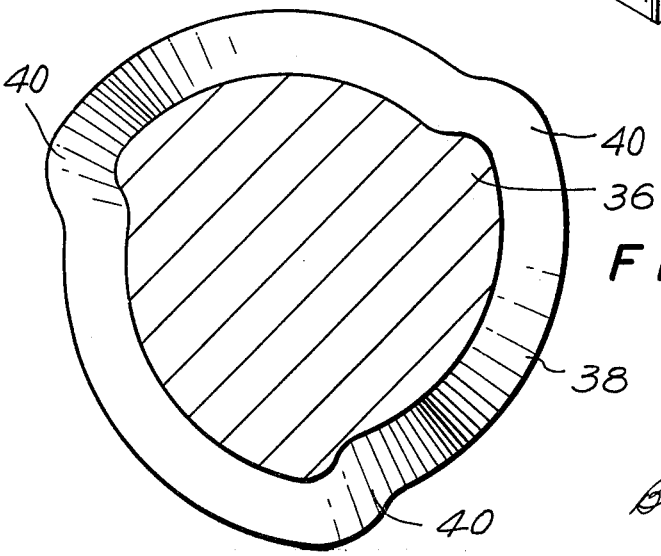
FIG. 10
INVENTOR.
LEON SIMONS
BY
Blum, Moscowitz, Friedman & Kaplan
ATTORNEYS

THREAD-ROLLING METHOD, THREAD-ROLLING DIES, AND METHOD OF MANUFACTURING THE DIES

This is a division of application Ser. No. 7,280 filed Jan. 30, 1970 and now abandoned.

BACKGROUND OF THE INVENTION

The present invention relates to screws.

In particular, the present invention relates to the threading of screws.

In the manufacture of screws, bolts, and any threaded fasteners, it is most common to employ thread-rolling dies in order to form threads on the screw shank.

In machines which are manufactured for this purpose, a headed blank is fed into a working position between a pair of opposed thread-rolling dies. These dies are simultaneously moved in opposite directions so that the screw shank which is to be threaded is rolled therebetween, and the dies are pressed toward each other, so that the thread which is on the dies is impressed into the blank screw shank. As a result the screw emerges from the dies with whatever thread was on the die faces. With structures of this type the shape of the thread may have any desired conformation, and the same is true of the particular helix angle of the thread.

Thread-rolling dies are conventionally manufactured by crush grinding in the case of a screw which has a straight cylindrical shank along its entire length. Thus, in the case of a machine screw it is possible to use such thread-rolling dies. However, the thread-rolling dies may also be manufactured by milling operations while the die blocks are in a soft condition. After the milling operations are completed the dies are hardened.

Dies of the above type, which have flat die faces, are simple dies and are not expensive to manufacture. However, when manufacturing screws which taper at the free end regions of the shanks so as to have a lead-in tip portion, the thread-rolling dies must have a configuration capable of forming the thread on the tapered tip region of the screw shank as well as on the non-tapered cylindrical shank portion which is of constant diameter all the way from the tapered tip region up to the head. Dies which can roll threads on such screw shanks obviously cannot be made by crush grinding or simple milling operations. Instead it is essential to manufacture such dies with a tool having a single cutting point, with the successive ridges and valleys being formed in the die face one at a time. There is machinery for carrying out operations of this type where, by means of a cam, the tool is caused to rise at the required angle at the areas where the die face is inclined so as to form the thread on the tapered free end region of the screw shank.

Equipment of this latter type is extremely expensive, and the operations in connection with cutting of the die faces of the thread-rolling dies is extremely tedious and extremely expensive as compared with the simple milling of a die which has a simple flat surface into which the thread-rolling ridges and valleys are milled, in a manner well-known in the manufacture of dies for thread-rolling simple machine screws which have non-tapered shanks of constant diameter throughout their entire length.

In recent years there has been the development of screws which are self-tapping and which form a thread not by cutting but by a swaging action. These results have been brought about by providing screw threads of lobular configuration in that the crests of the threads have lobular projections formed thereon according to a given pattern of distribution along the thread. The lobes may be distributed in a triangular pattern so that each thread convolution has three lobes, or more or less lobes may be provided. The lobes may be arranged axially along the screw thread, along lines parallel to the axis of the screw, or the lobes may be arranged along spiral lines having any desired inclination with respect to the helix along which the thread extends.

At the present time, screws of this latter type, where lobes are oriented along straight or spiral lines, are manufactured with extremely involved and costly methods and apparatus, requiring, for example, the use of essentially predrawn triangular wire, with trilobular guides, cut-off blades, and cold-heading dies. All of the tools of this latter type are quite expensive when they require conformations of this latter type in order to achieve a trilobular configuration for the screw thread.

SUMMARY OF THE INVENTION

It is accordingly a primary object of the present invention to provide a screw manufacturing method as well as dies to be used in the manufacture of screws and methods for manufacturing the dies which greatly reduce the costs which are involved in the manufacture of screws such as screws which have tapered tip regions at their shanks and screws which have lobular projections along the crests of the screw threads.

In particular, it is an object of the invention to provide a method which makes it possible to manufacture a screw thread with lobular conformations thereon in a single rolling operation, so that in the single rolling operation which heretofore was required in the manufacture of simple machine screws it is also possible with the method of the invention to achieve lobular screw threads.

Yet another object of the present invention is to provide relatively inexpensive thread-rolling dies capable of forming threads on shanks with tapered tip regions as well as capable of forming threads with lobular conformations.

Also it is an object of the invention to provide an exceedingly inexpensive method for manufacturing such dies.

According to the invention the thread-rolling die is initially in the form of a pair of separate blocks on which the die faces are individually formed, with one of these die faces being inclined. After the dies are formed by milling while the metal is relatively soft, the die blocks are joined together so that the ridges and valleys formed on the inclined die face register properly with the ridges and valleys formed on the flat die face, and with the die blocks thus joined to each other, the entire unit is hardened and the sides and bottom is then ground so that the die will be ready for use. In order to form threads with lobular conformations, before the blocks are joined to each other suitable tools are pressed across the ridges at the die faces to form therein indentations of predetermined configuration and distribution which will achieve for the finished screw the required conformation and distribution of lobular projections. Thus, with this construction it is possible to manufacture a screw having a tapered tip region at its shank with a screw thread formed on the shank in a single rolling operation during which lobular conformations are also formed, so that the latter are formed simultaneously with the thread during the single operation.

BRIEF DESCRIPTION OF DRAWINGS

The invention is illustrated by way of example in the accompanying drawings which form part of this application and in which:

FIG. 6 is a fragmentary schematic top plan view of a thread-rolling die of the invention according to which the indentations which form the lobular conformations are arranged in a different pattern from FIG. 4;

FIG. 7 is a fragmentary schematic top plan view of a die of the invention similar to FIGS. 4 and 6, except that in FIG. 7 the lobe-forming indentations are arranged in yet another different pattern in the die ridges;

FIG. 8 is a perspective illustration of a pressing tool used for pressing the lobe-forming indentations into the ridges of the inclined die face section;

FIG. 9 is a perspective illustration of the tool used to press the lobe-forming indentations in the ridges of the flat die face section; and FIG. 10 is a transverse section, at an enlarged scale, of a screw shank provided with the thread which has the lobular conformation achieved with the method and apparatus of the invention.

DESCRIPTION OF PREFERRED EMBODIMENTS

Figure 2:
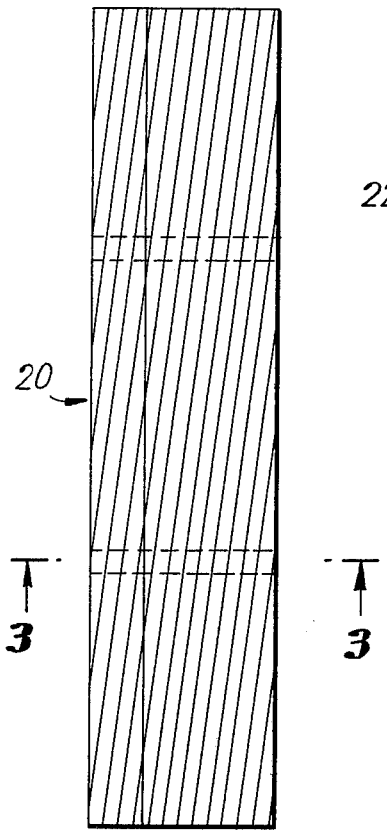
FIG. 2 is a schematic top plan view of the thread-rolling die of the invention in its completed condition.
Figure 1:
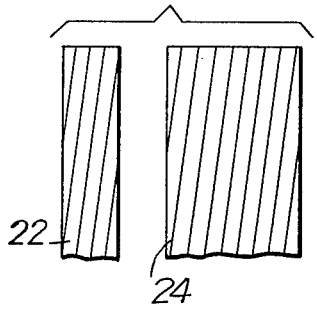
FIG. 1 is a fragmentary schematic top plan view of a pair of bodies which together form a thread-rolling die of the invention.
Figure 3:
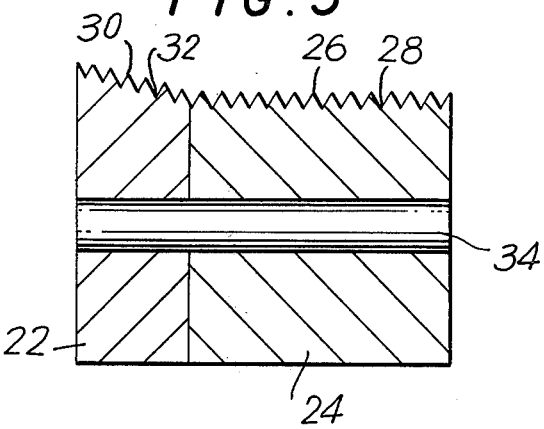
FIG. 3 is a transverse sectional elevation of the die of FIG. 2 in the direction of the arrows and showing the structure at an enlarged scale.

Referring first to FIGS. 1–3, the thread-rolling die 20 shown in FIG. 2 initially is made from a pair of individual die blocks 22 and 24 which are shown fragmentarily separated from each other in FIG. 1. FIG. 1 is a plan view illustrating the die faces of the blocks 22 and 24. Thus these die blocks 22 and 24 are initially in the form of blocks of a suitable metal with the block 24 having a flat die surface to receive the ridges and valleys 26 and 28 apparent from FIG. 3. The die block 22 has an upper inclined surface which receives the ridges and valleys 30 and 32 apparent from FIG. 3. While the metal of the die blocks 22 and 24 is still relatively soft, the ridges and valleys 26, 28 are milled into the die face of the block 24 and the ridges and valleys 30, 32 are milled into the inclined die face of the block 22. It will be noted that the right legs of the ridges 30, as viewed in FIG. 3, are longer than the left legs, so that in this way it is possible for the ridges and valleys to progress upwardly along the inclined surface of the block 22 while maintaining for the ridges and valleys 30, 32 the same construction as the ridges and valleys 26, 28.

Once these ridges and valleys are milled into the die faces, the die blocks 22 and 24 are placed against each other, so that they are no longer in the separate condition illustrated in FIG. 1. In placing the die blocks one next to the other, care is taken to see to it that the ridges of the block 22 form precise continuations of the ridges of the block 24, as is apparent from FIG. 2. With the blocks thus properly and precisely positioned with respect to each other and in engagement with each other, the blocks are united to form a single die unit 20, and any possible structure may be used for this purpose. In the illustrated example suitable dowels 34 are pressed into aligned bores of the die blocks so that they are permanently held together in the condition illustrated in FIGS. 2 and 3.

With the blocks 22 and 24 thus assembled to form the thread-rolling die 20, the entire unit is hardened, and then the sides and bottom of the unit are ground so that the thread-rolling die is then ready for use.

It is thus apparent that with the above-described method of manufacture of the thread-rolling die 20 shown in FIGS. 1–3, considerable economies are achieved as contrasted with conventional die-manufacturing operations. It is unnecessary to provide expensive machines which have a tool with a single point required to cut only one valley at a time, and with a cam required to cause the tool to rise upwardly along the inclined surface. Instead the milling operations are carried out in an extremely inexpensive manner on the separate blocks 22 and 24, and after these blocks are joined together the hardening of the unitary assembly achieves the full equivalent of thread-rolling dies which heretofore required the expensive manufacturing operations of the above type. With this construction it is possible to roll threads onto shanks which terminate in tapered tip regions, the tapered tip region having the thread rolled into the same at the inclined die face portion while the non-tapering cylindrical shank has the thread rolled into the latter at the flat die face portion.

While it is possible with a pair of dies of the type shown in FIGS. 1–3 to roll threads into a screw shank having a tapered tip region, these threads will have a simple helical crest free of any projections of any type. It is highly desirable for many purposes, however, to roll a thread which has projections such as the trilobular conformation illustrated in FIG. 10. Thus, referring to FIG. 10, there is illustrated in section a screw shank 36 formed at its exterior with a thread 38. The thread 38 is of a constant height around the entire circumference of each convolution. The crest of the thread is formed with the lobular conformations 40, and of course the root of the thread is formed with a corresponding conformation to maintain the constant height of each thread between its root and crest.

Figure 4:
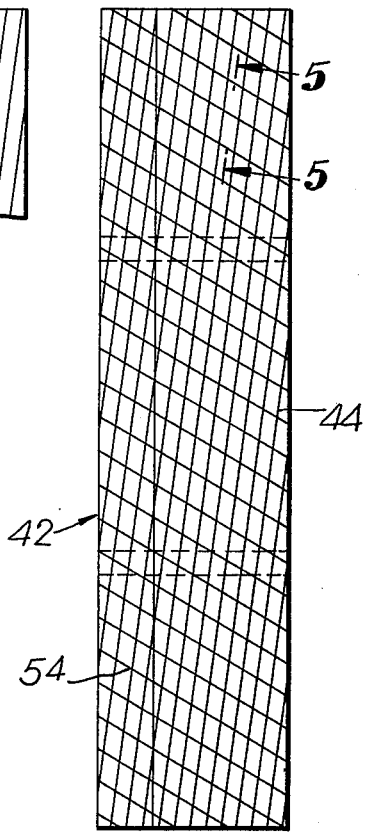
FIG. 4 is a schematic top plan view of a thread-rolling die similar to that of FIGS. 2 and 3 except that the die of FIG. 4 is capable also of forming lobular conformations on the thread.
Figure 5:
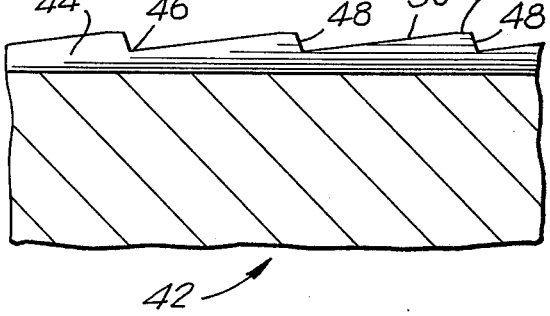
FIG. 5 is a fragmentary longitudinal sectional elevation taken along line 5—5 of FIG. 4 in the direction of the arrows and showing at a greatly enlarged scale, as compared to FIG. 4, the configurations of the die ridges which result in the formation of the desired lobular conformations with the particular example illustrated in FIG. 4.

A thread of the type shown in FIG. 10 may be achieved in accordance with the method and apparatus of the invention in a single rolling operation with thread-rolling dies having the construction shown in FIGS. 4 and 5. The die 42 shown in FIGS. 4 and 5 has its ridges 44 formed with a series of indentations 46. These indentations 46 have a relatively sharp drop 48 at one end and a gradually rising portion 50 reaching the straight portion 52 at the crest of the ridge before the next drop 48 is reached. These indentations 46 are arranged angularly with respect to the ridges 44 along the lines 54 shown in FIG. 4. Thus, with dies of this construction when the shank with the tapered tip region is rolled between the oppositely moving dies which are pressed toward each other, the thread will be formed with the lobular conformations apparent from the enlarged illustration in FIG. 10. It is apparent from FIG. 10 that the threads have at each convolution the gradual rise followed by relatively sharp drop to produce the lobular conformations 40 illustrated in FIG. 10.

The indentations 46 along the lines 54 in the flat die face region by the tool 56 shown in FIG. 9. This tool 56 has the teeth 58 the configuration of which will provide indentations 46 as shown in FIG. 5 at an enlarged scale. This tool 56 is pressed across the ridges 44 to achieve the lines of indentations 46 illustrated at 54 in FIG. 4.

In order to achieve the indentations 46 at the inclined region of the die face, the tool 60 shown in FIG. 8 is used. This tool 60 has the indentation-forming points 62 the configuration of which will result in indentations 46 as shown in FIG. 5 but located along the inclined section of the die face.

The lobular conformations 40 achieved with the dies 42 are developed spirally along the thread 38 formed on the shank 36. In the event that it is desired to have the lobular conformations distributed so that they are arranged along straight lines which are parallel to the axis of the screw, then an arrangement as shown in FIG. 6 is provided. According to this arrangement the die 64 is identical with the die of FIGS. 4 and 5, the only difference being that the indentations 46 are arranged along the lines 66 which extend straight across the die faces. Thus, when a screw shank is rolled between a pair of dies having the construction of FIG. 6, the lobular conformations are developed and axially distributed as three areas of conformations uniformly distributed about the shank axis and extending parallel thereto.

If it is desired to reverse the inclination of the spiral distribution of the lobular conformation, then instead of a die as shown in FIGS. 4 and 5 it is possible to use a die 68 as shown in FIG. 7. With this die the construction again is identical with that of FIGS. 4 and 5 except that in this case the indentations are pressed into the ridges along the lines 70 which are inclined oppositely to the lines 54. Thus this arrangement also will result in a spiral distribution of the lobular conformations but at an inclination which is opposite to that of the screw thread achieved from the die 42.

It is apparent, therefore, that with the method and apparatus of the invention it is possible to achieve in an extremely inexpensive manner screw threads having lobular conformations distributed therealong according to any predetermined pattern. It is emphasized that with the method of the invention in the single thread-rolling operation not only is the thread formed at the exterior of the screw shank but in addition the lobular conformations, such as the conformations 40 of FIG. 10 are also simultaneously formed, so that without requiring any preformed wire of triangular cross-section, for example, it is possible to directly roll in a simple inexpensive manner not only conventional threads but also threads having lobular conformations.

What is claimed is:

1. A method of manufacturing a thread-rolling die having flat and inclined die face regions for rolling threads onto screw shanks which have tapered free end regions the steps of milling ridges and valleys into blank surfaces of a pair of die blocks, one of which has a flat face into which the ridges and valleys are milled and the other of which has an inclined face into which the valleys and ridges are milled, placing the thus milled blocks one next to the other with the milled die faces thereof in proper registry to achieve the required continuity between ridges and valleys which extend onto the die faces of both blocks, fastening the blocks together, then hardening the thus-fastened blocks, and finally grinding the sides and bottoms of the blocks prior to use thereof, and prior to joining of the blocks to each other, but subsequent to the milling of the ridges and valleys therein, causing pressing tools to be pressed across the ridges for forming therein indentations arranged along lines extending at given angles with respect to the ridges, so that the completed thread-rolling die will form lobular threads arranged according to a predetermined pattern.

2. In a method for manufacturing a thread-rolling die, the steps of milling into a blank surface of die block ridges and valleys extending along the milled surface to form a die face, then pressing across the thus-formed ridges a tool which forms in the ridges indentations distributed along lines which extend at a given angle across the ridges, so that the die can be used for forming lobular threads and then hardening the block, and finally grinding the sides and bottom thereof to prepare the block for use.

* * * * *

UNITED STATES PATENT OFFICE

CERTIFICATE OF CORRECTION

Patent No. 3,945,272 Dated March 23, 1976

Inventor(s) Leon Simons

It is certified that error appears in the above-identified patent and that said Letters Patent are hereby corrected as shown below:

Column 3, line 14, after "Fig. 2", insert --taken along line 3-3 of Fig. 2--.

Column 5, line 10, after "region" insert --are pressed into the ridges 44 at the flat die face region--.

Signed and Sealed this twenty-ninth Day of June 1976

[SEAL]

Attest:

RUTH C. MASON
Attesting Officer

C. MARSHALL DANN
Commissioner of Patents and Trademarks